US011497978B2

(12) United States Patent
Coppaken et al.

(10) Patent No.: US 11,497,978 B2
(45) Date of Patent: Nov. 15, 2022

(54) WRIST AND ELBOW STABILIZER FOR SPORTS TRAINING

(71) Applicant: Flyt Golf, LLC, Overland Park, KS (US)

(72) Inventors: Jeff Coppaken, Overland Park, KS (US); Brad Smith, Overland Park, KS (US)

(73) Assignee: Flyt Golf, LLC, Overland Park, KS (US)

( * ) Notice: Subject to any disclaimer, the term of this patent is extended or adjusted under 35 U.S.C. 154(b) by 0 days.

(21) Appl. No.: 17/097,564

(22) Filed: Nov. 13, 2020

(65) Prior Publication Data

US 2021/0146212 A1 May 20, 2021

Related U.S. Application Data

(60) Provisional application No. 62/935,800, filed on Nov. 15, 2019.

(51) Int. Cl.
*A63B 69/36* (2006.01)
*A63B 69/00* (2006.01)

(52) U.S. Cl.
CPC ..... *A63B 69/0059* (2013.01); *A63B 69/3608* (2013.01)

(58) Field of Classification Search
CPC ..... A63B 69/0059; A63B 69/3608
USPC ..... 473/212–214
See application file for complete search history.

(56) References Cited

U.S. PATENT DOCUMENTS 2,468,580 A * 4/1949 Weis ..... A63B 69/0059 473/214
3,423,095 A * 1/1969 Cox ..... A63B 69/0059 473/213
3,658,345 A * 4/1972 Siggson ..... A63B 69/0059 473/214
3,990,709 A * 11/1976 DeRogatis ..... A61F 5/05858 473/214
4,013,070 A * 3/1977 Harroff ..... A61F 5/0109 602/21
4,330,120 A * 5/1982 Netti ..... A63B 21/065 2/160
4,504,054 A * 3/1985 Jackson ..... A63B 69/0059 473/214
4,615,339 A * 10/1986 Siwek ..... A61F 5/373 128/878
5,207,430 A * 5/1993 Goins ..... A63B 69/0059 473/213
5,695,453 A * 12/1997 Neal ..... A61F 5/0118 602/21
7,097,571 B2 * 8/2006 Kraus ..... A63B 69/3608 473/212

(Continued)

*Primary Examiner* — Nini F Legesse
(74) *Attorney, Agent, or Firm* — Shook, Hardy & Bacon, L.L.P.

(57) ABSTRACT

A golf training aid is described that stabilizes a wrist and an elbow of a golfer during a golf swing. The golf training aid includes a flexible sleeve and an elongated rigid insert. The flexible sleeve is configured to receive the wrist and the elbow of the golfer. The elongated rigid insert is secured to the flexible sleeve. The flexible sleeve keeps the rigid insert in contact with the wrist and the elbow of the golfer so as to prevent pivoting of the wrist and pivoting of the elbow.

19 Claims, 8 Drawing Sheets

(56) References Cited

U.S. PATENT DOCUMENTS

| | | | | |
|---|---|---|---|---|
| 8,235,927 | B2 * | 8/2012 | Bauerfeind | A61F 5/0118 602/21 |
| 9,233,290 | B2 * | 1/2016 | Woody | A63B 69/0059 |
| 9,950,232 | B2 * | 4/2018 | Middleton | A63B 69/0059 |
| 2007/0093310 | A1 * | 4/2007 | Moscovici | A63B 69/3623 473/212 |
| 2010/0190564 | A1 * | 7/2010 | Lindby | A63B 69/3623 473/214 |
| 2013/0337927 | A1 * | 12/2013 | Buchanan | A63B 69/0059 473/213 |

* cited by examiner

WRIST AND ELBOW STABILIZER FOR SPORTS TRAINING

RELATED APPLICATIONS

This non-provisional patent application claims priority benefit, with regard to all common subject matter, of commonly assigned U.S. provisional patent application Ser. No. 62/935,800, filed Nov. 15, 2019, and entitled "WRIST AND ELBOW STABILIZER FOR SPORTS TRAINING." This provisional patent application is hereby incorporated by reference in its entirety into the present application.

BACKGROUND

1. Field

Embodiments of the invention relate broadly to sports training equipment. More specifically, embodiments of the invention relate to golf training aids and other swinging sport training aids.

2. Related Art

Golf is a sport which requires consistency in swinging motion for good results. A typical golf swing includes movements about many joints of the body simultaneously. As an example, these movements can include bending at the knees, twisting at the waist, bending at the waist, twisting at the shoulder, bending and twisting at the head, bending at the wrist and elbow of the leading arm, and bending at the wrist and elbow of the trailing arm. In order for a golfer to make good shots, the body motion of the swing must be consistent and properly aligned. Various training devices have been developed which focus on stabilizing one of these movements.

What is lacking in the prior art is a device for teaching a golfer to reduce multiple movements so as to increase the consistency and alignment of a swing. This background discussion is intended to provide information related to the present invention which is not necessarily prior art.

BRIEF SUMMARY

Embodiments of the invention solve the above-mentioned problems and provide a distinct advance in the art by providing a golf training aid to prevent movement of the wrist and elbow of the trailing arm during the swinging motion. This stabilization increases the consistency and alignment of the swing. The stabilization keeps the club wider and shallower relative to the ball. This results in a reduction of "fat" shots and "thin" shots, discussed below.

A first embodiment of the invention is broadly directed to a golf training aid configured to stabilize a wrist and an elbow of a golfer or other user. The golf training aid includes a flexible sleeve and an elongated rigid insert. The flexible sleeve is configured to receive the wrist and the elbow of the golfer. The elongated rigid insert is secured to the flexible sleeve. The flexible sleeve keeps the rigid insert in contact with the wrist and the elbow of the golfer so as to prevent pivoting of the wrist and pivoting of the elbow.

A second embodiment of the invention is broadly directed to a golf training aid configured to stabilize a wrist and an elbow of a golfer. The golf training aid includes a flexible sleeve and an elongated rigid insert. The flexible sleeve is configured to receive the wrist and the elbow of the golfer. The elongated rigid insert is secured to the flexible sleeve.

The flexible sleeve keeps the rigid insert proximate with the wrist and the elbow of the golfer so as to prevent pivoting of the wrist and pivoting of the elbow. The flexible sleeve includes a sealed insert pocket. The elongated rigid insert is disposed within the sealed insert pocket of the flexible sleeve.

A third embodiment of the invention is broadly directed to a method of golf training comprising: acquiring a golf training aid including a flexible sleeve configured to receive the wrist and the elbow of the golfer, and an elongated rigid insert secured to the flexible sleeve; donning the golf training aid; grasping a golf club; and swinging the golf club. The flexible sleeve of the golf training aid keeps the rigid insert proximate with the wrist and the elbow of the golfer so as to prevent pivoting of the wrist and pivoting of the elbow during the swing.

Other embodiments of the invention may be broadly directed to a method of manufacturing a golf training aid as described herein. Still other embodiments of the invention may be directed to a method instructing golf training utilizing the golf training aid. Yet still other embodiments may be directed to playing a golf game while wearing the golf training aid for a first portion of the golf game and playing golf while with the golf training aid removed for a second portion of the golf game.

Advantages of these and other embodiments will become more apparent to those skilled in the art from the following description of the exemplary embodiments which have been shown and described by way of the figures. As will be realized, the present embodiments described herein may be capable of other and different embodiments, and their details are capable of modification in various respects. Accordingly, the drawings and description are to be regarded as illustrative in nature and not as restrictive.

BRIEF DESCRIPTION OF THE DRAWINGS

The Figures described below depict various aspects of systems and methods disclosed therein. It should be understood that each Figure depicts an embodiment of a particular aspect of the disclosed systems and methods, and that each of the Figures is intended to accord with a possible embodiment thereof. Further, wherever possible, the following description refers to the reference numerals included in the following Figures, in which features depicted in multiple Figures are designated with consistent reference numerals. The present embodiments are not limited to the precise arrangements and instrumentalities shown in the Figures.

FIG. 5C is a side view of the rigid insert of FIG. 5A;

Figure 1A:
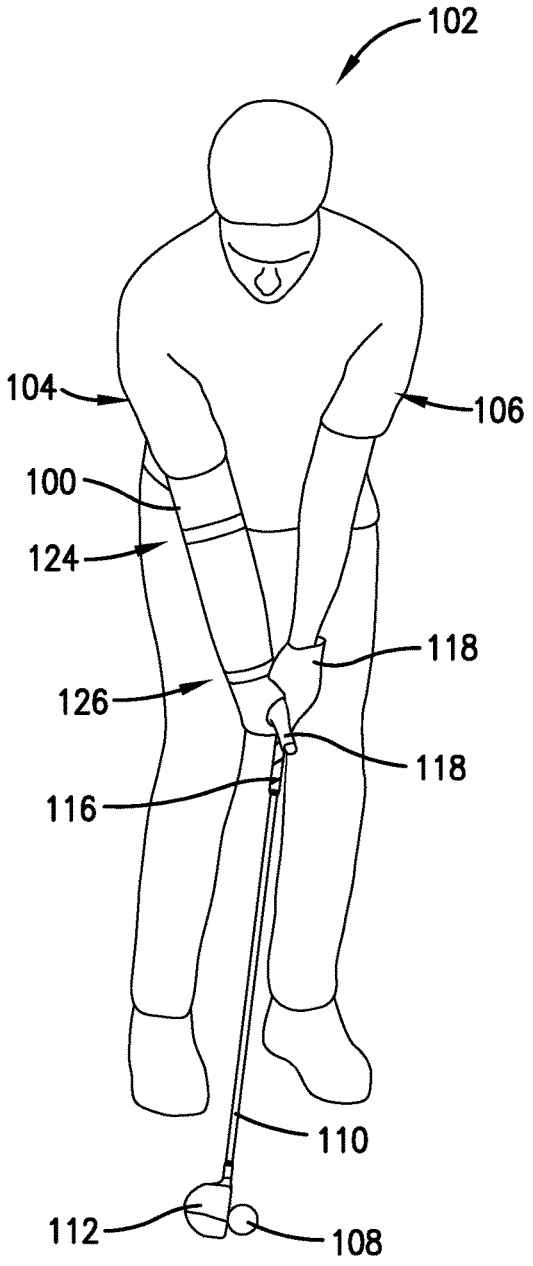
FIG. 1A is a side view showing a golfer utilizing an embodiment of a golf training aid in a starting position.

The Figures depict exemplary embodiments for purposes of FIG. only. One skilled in the art will readily recognize from the following discussion that alternative embodiments of the systems and methods illustrated herein may be employed without departing from the principles of the invention described herein. While the drawings do not necessarily provide exact dimensions or tolerances for the illustrated components or structures, the drawings, not including any purely schematic drawings, are to scale with respect to the relationships between the components of the structures illustrated therein for at least one embodiment of the invention. Other embodiments may differ in scale and structures from the presented drawings.

DETAILED DESCRIPTION

The present invention is susceptible of embodiment in many different forms. While the drawings illustrate, and the specification describes, certain preferred embodiments of the invention, it is to be understood that such disclosure is by way of example only. There is no intent to limit the principles of the present invention to the particular disclosed embodiments. For instance, the drawing figures do not limit the present invention to the specific embodiments disclosed and described herein. Furthermore, directional references (for example, top, bottom, up, and down) are used herein solely for the sake of convenience and should be understood only in relation to each other. For instance, a component might in practice be oriented such that faces referred to as "top" and "bottom" are sideways, angled or inverted relative to the chosen frame of reference.

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments but is not necessarily included. Thus, the present technology can include a variety of combinations and/or integrations of the embodiments described herein.

The following description of embodiments of the invention references the accompanying Illustrations that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the invention. The following detailed description is, therefore, not to be taken in a limiting sense.

Exemplary Environment and Usages

Embodiments of the invention may be utilized in any of various environments. An exemplary environment is shown in FIG. 1 and discussed below. However, it should be appreciated that this environment is only exemplary and that various embodiments of the invention may be utilized in other environments. The following description references the game of golf as a field of use for the invention. This field of use is exemplary and for ease of understanding of the reader. Other embodiments of the invention may be utilized for swinging motions in other sports and activities. For example, other embodiments of the invention may be configured for use in baseball, softball, cricket, hockey, tennis, table tennis, racquet ball, etc.

Embodiments of the invention are configured to be used in the training for and playing of golf. There are three types of swings typically utilized in golf. The first type of swing is a full driving swing. The full driving swing is typically utilized on the first swing of a round and is typically performed on a ball that is placed upon a tee. The full driving swing is designed to provide maximum speed (and, by extension, distance) off the tee. The second type of swing is a putting swing. The putting swing is typically utilized on the "green" in relative proximity to the hole. The putting swing is designed to provide maximum accuracy, so as to place the ball directly into the hole.

The third type of swing is a mid-range swing. Mid-range swings are typically utilized between the driving swing and the putting swing, at locations between the tee box and the green (such as the fairway, the rough, hazards, etc.) The mid-range swing may be a chipping swing or a pitching swing. A chipping swing is designed to induce a ball flight that is more horizontal than vertical. The chip shot stays relatively close to the ground and bounces for most of the time following impact. A pitching swing is designed to induce a ball flight that is more vertical than horizontal. The pitch shot travels high in the air, such as to avoid terrain hazards, and does not travel extensively after a bounce. Typically, the golfer will select whether to pitch or chip based upon any of various factors, such as distance to the hole, the surrounding terrain, nearby hazards, etc.

Figure 1B:
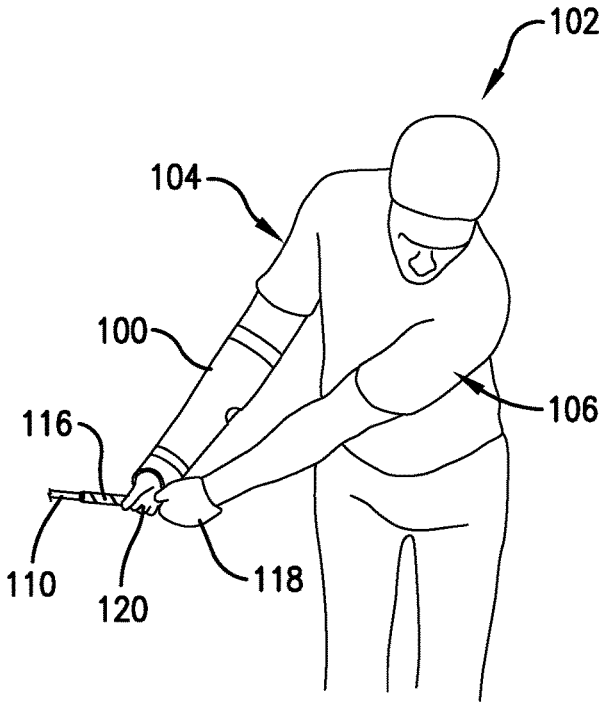
FIG. 1B is a partial side view showing the golfer of FIG. 1A in a backswing position associated with a golf swing.

Embodiments of the invention are configured to be utilized for mid-range swings, such as a pitching swing and/or a chipping swing, rather than for a full driving swing or a putting swing. FIG. 1 shows utilization of an embodiment of the invention. A golf training aid 100 100 is worn by a golfer 102 on a trailing arm 104. The trailing arm 104 is disposed rearward during the swing and follows a leading arm 106. The golf training aid 100 improves the flight path of a golf ball 108 by assisting the golfer in keeping proper alignment of a golf club 110. The golf club 110 includes a club head 112 disposed at a distal end of a club shaft 114. The golf club 110 also include a club grip 116 disposed at a proximal end of the club shaft 114. More specifically, the golfer 102 grips the club grip 116 with a thumb 118 (as illustrated in FIG. 1A) and set of four fingers 120 (as illustrated in FIG. 1B). The golfer 102 may also wear a golfing glove 122 on the leading arm 106 (as illustrated in FIGS. 1A-B).

Figure 1C:
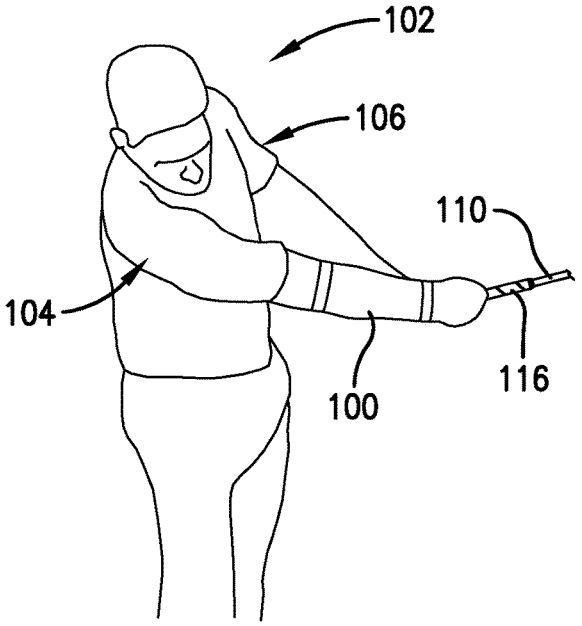
FIG. 1C is a partial side view showing the golfer of FIG. 1A in a follow-through position of the golf swing.

In the example FIGS. 1A-C, the golfer 102 is right-handed, and thus wears the golf training aid 100 on a right arm of the golfer 102 (the trailing arm 104 during the swing). FIGS. 1A-C shows three positions of the swing. In FIG. 1A, a start position is shown. In this position, the golfer 102 rests the club head 112 directly behind the golf ball 108. This is also an impact position where the golfer 102 will strike the ball during the swing. Thus, the golfer 102 wants to return to the starting position with a proper velocity and alignment when striking the ball. In FIG. 1B, a backswing position is shown. In this position, the golfer 102 is preparing to begin the forward motion of the swing. It should also be noted that this is not a full backswing position (such as would be used on a driving shot and would require bending of an elbow 124 and a wrist 126 of the trailing arm 104). Instead, a backswing of a chipping or pitching swing is shown. In FIG. 1C, a follow-through position is shown. In this position, the golfer 102 continues the forward swing after contact with the ball. It should also be noted that this is not a full follow-through position (such as would be used on a driving shot and would require bending of the elbow 124 of the trailing arm 104).

Figure 2:
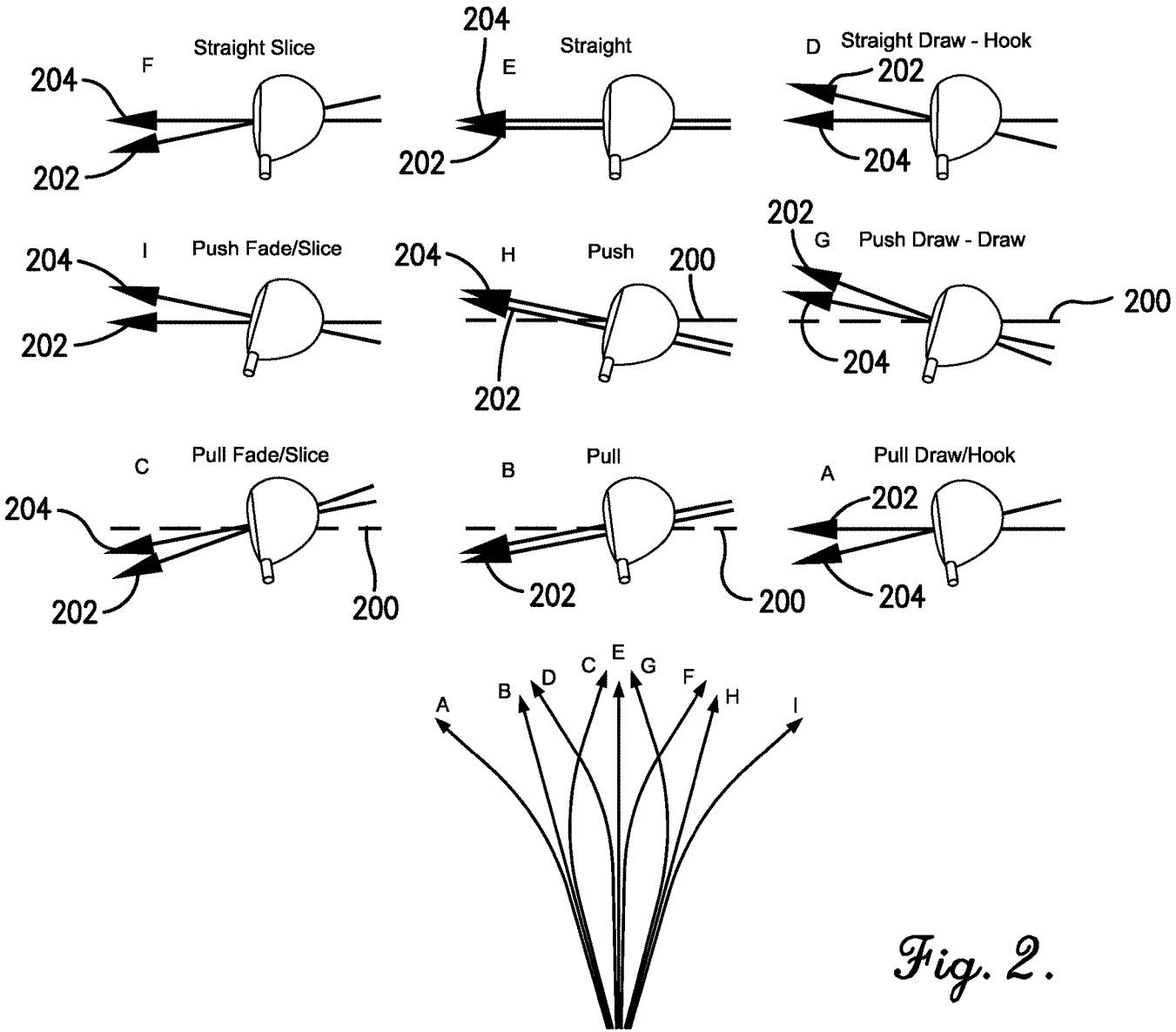
FIG. 2 is a diagram showing effects of improper swing on ball flight.

By assisting the golfer with positioning the elbow 124 and wrist 126 during the swing, as discussed below, the golf training aid 100 reduces the likelihood of an errant swing being imparted on the ball. Turning to FIG. 2, a diagram showing effects of various golf swings on resultant flight characteristics is shown. A straight-line reference 200 is shown. The golf ball 108 should start and remain generally aligned with the straight-line reference 200 during flight. The club head 112 presents a club face which directly strikes the golf ball 108 (not shown in FIG. 2). The club face strikes the golf ball 108 at a facial direction of travel 202 and a facial orientation 204 (which may include an aligned direction and orientation 206). The facial orientation 204 can be generally straight (as shown in diagrams F, E, and D), push (e.g., to the right, as shown in diagrams I, H, and G), or pull (e.g., to the left, as shown in diagrams C, B, and A). The facial direction of travel can be aligned with the facial orientation 204 (e.g., the aligned direction and orientation 206, as shown in diagrams E, H, and B), slicing (e.g., angled to the right, as shown in diagrams F, I, and C), or hooking (e.g., angled to the left, as shown in diagrams D, G, and A). A combination of the facial direction of travel 202 and the facial orientation 204 impacts a resultant trajectory 208.

The golf training aid 100 prevents or inhibits pivoting or bending of the wrist 126 and the elbow 124. This provides consistency in the swing, by eliminating minor movements during the swing which may result in the ball not being correctly struck. This position also keeps the club wider and shallower relative to the ball. This position also helps the golfer 102 extend through the follow-through of the swing.

Embodiments of the invention may also reduce "fat" and "thin" shots. A "fat" shot is one in which the club head 112 strikes the ground behind the ball. A "thin" shot is one in which the club head 112 strikes the ball on a bottom portion of the club head 112. By improving the consistency of the swing, these fat and thin shots may be reduced.

The golfer 102 may wear the golf training aid 100 during practice swings. The repetitive motion will teach the muscle memory of keeping the wrist 126 and elbow 124 straight. The golfer 102 may also selectively wear the golf training aid 100 during a full game of golf, by wearing the golf training aid 100 only during the chipping and pitching shots of the golf game. Exemplary methods of use of embodiments of the invention are discussed more below.

Exemplary Golf Training Aid

Figure 3A:
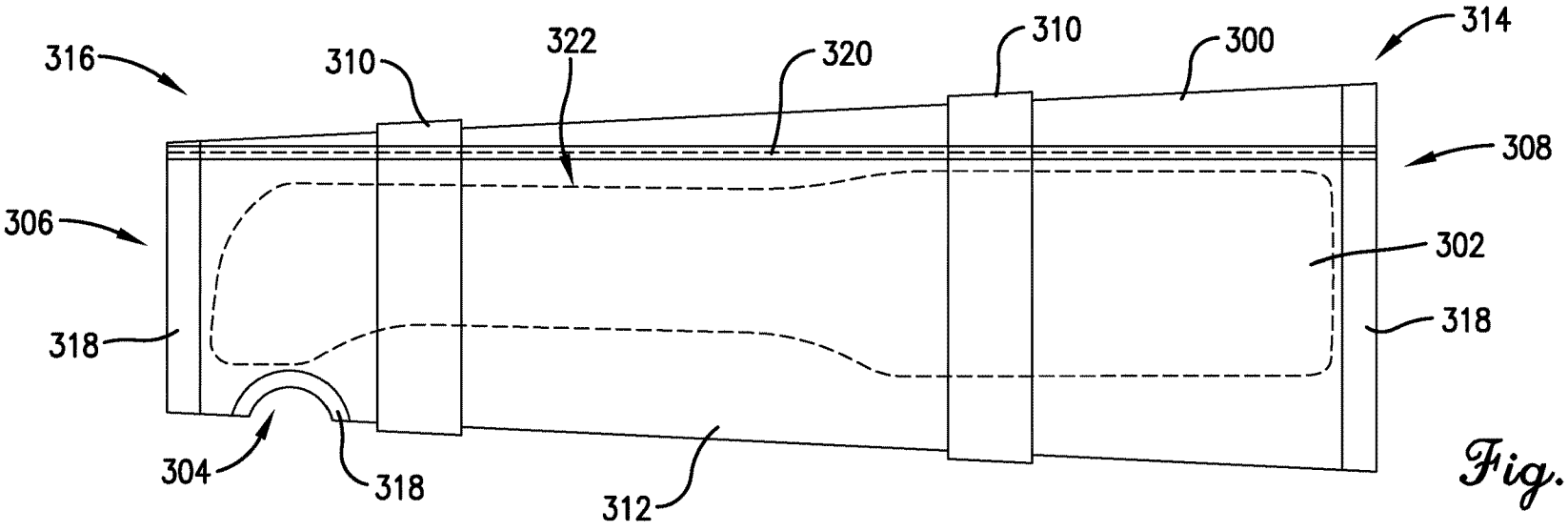
FIG. 3A is a top side view of the golf training aid of FIG. 3, showing attached fastening straps and a rigid insert therein.
Figure 3B:
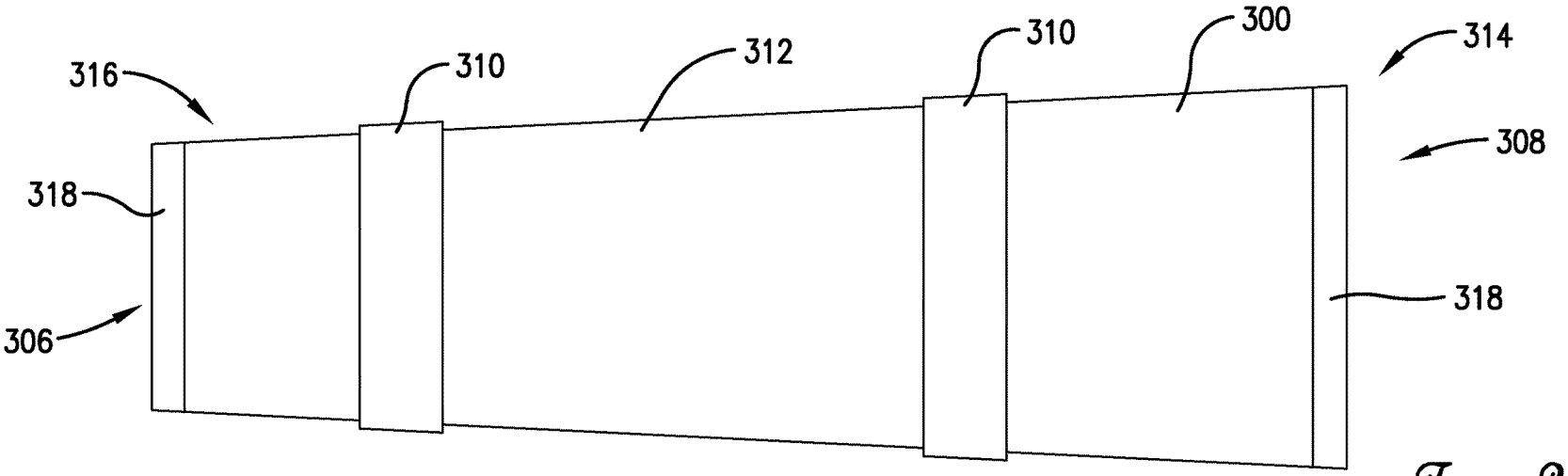
FIG. 3B is a side view of the golf training aid of FIG. 4A.
Figure 4:
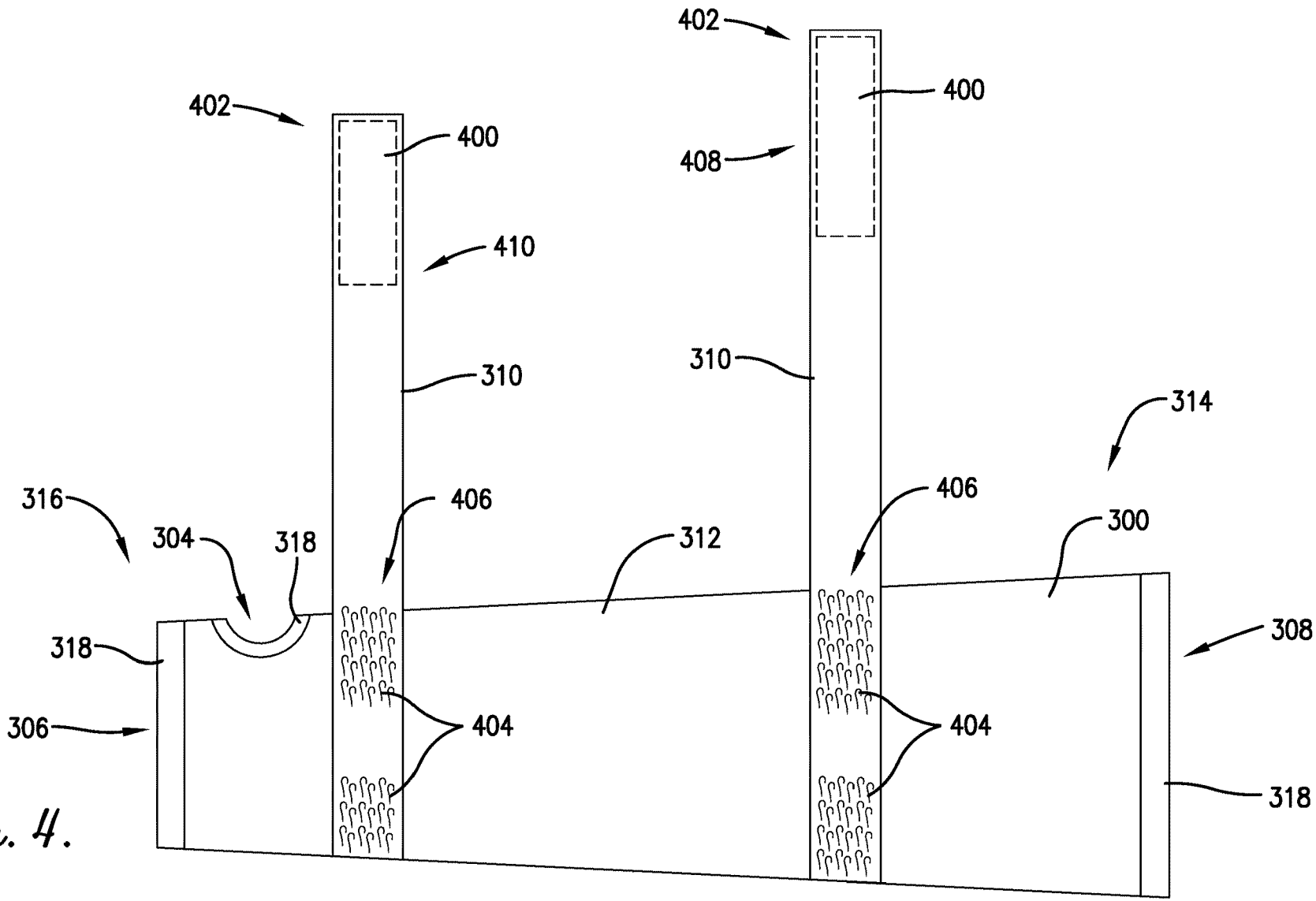
FIG. 4 is a top side view of the golf training aid, showing extended fastening straps.

Turning to FIGS. 3A-5G, an exemplary embodiment of the golf training aid 100 is shown. Broadly, the golf training aid 100 comprises a flexible sleeve 300 and a rigid insert 302. FIGS. 3-4B show the flexible sleeve 300 of the golf training aid 100. FIGS. 5A-G show the rigid insert 302 individually. Embodiments of the invention are directed to a golf training aid 100 configured to inhibit bending or pivoting of the wrist 126 and elbow 124 during a pitching or chipping swing. The rigid insert 302 provides the above discussed benefits of keeping the wrist 126 and elbow 124 stable during the swing. The flexible sleeve 300 is configured to be worn on the trailing arm 104 of the golfer 102. The flexible sleeve 300 keeps the rigid insert 302 in place relative to the trailing arm 104 of the golfer 102. The rigid insert 302 is secured to the flexible sleeve 300, as discussed below. The rigid insert 302 is shown in FIG. 3A outlined within the flexible sleeve 300.

A golf training aid 100 of embodiments of the invention is configured to stabilize a wrist 126 and an elbow 124 of a golfer 102. The golf training aid 100 includes a flexible sleeve 300 and an elongated rigid insert 302. The flexible sleeve 300 is configured to receive the wrist 126 and the elbow 124 of the golfer 102. The elongated rigid insert 302 is secured to the flexible sleeve 300. The flexible sleeve 300 keeps the rigid insert 302 in contact with the wrist 126 and the elbow 124 of the golfer 102 so as to prevent pivoting of the wrist 126 and pivoting of the elbow 124.

FIGS. 3A-B shows an embodiment of the golf training aid 100. The flexible sleeve 300 includes a thumb opening 304 (on the bottom left of FIG. 3A), a hand opening 306 (on the left of FIGS. 3A-B), and an arm opening 308 (on the right of FIG. 3A-B). In applying the golf training aid 100, the golfer 102 places their hand into the arm opening 308 and slides the flexible sleeve 300 over their trailing arm 104. The golfer 102 then places four fingers 120 out the hand opening 306 and a thumb 118 out the thumb opening 304. The golfer 102 will then apply one or more fastening straps 310 (such as a hook-and-loop connector, commonly referred to as VELCRO straps) to secure the flexible sleeve 300 in place.

In embodiments of the invention, the golf training includes a flexible sleeve 300. The flexible sleeve 300 is flexible such that it is configured to receive the wrist 126 and the elbow 124 of the golfer 102 therein. The flexible sleeve 300 is, in a default position, smaller in volume than a volume of a typical forearm of the golfer 102. The flexible sleeve 300 thus elastically expands over the forearm of the golfer 102 so as to remain tightly in contact with the forearm. The flexible sleeve 300 may also include fastening straps 310 to increase how tightly the flexible sleeve 300 remains in contact with the forearm.

The flexible sleeve 300 includes a flexible sheet 312 that is disposed in a generally open-ended cylinder shape. The flexible sleeve 300 includes an arm end 314 (configured to be proximate to the elbow 124 of the golfer 102 when worn) and an hand end 316 (configured to be proximate to the wrist 126 of the golfer 102 when worn). The flexible sheet 312 is disposed between in the open-ended cylinder shape between the arm end 314 and the hand end 316. The flexible sheet 312 may be sewn or otherwise secured in the open-ended cylinder shape from a single sheet of fabric or other material. The flexible sheet 312 may include one or more hems 318 along an edge. The hems 318 provide protection to an edge of the flexible sheet 312 and provide increased comfort for the golfer 102. Seems 320 may be disposed between adjacent segments of the flexible sheet 312 (as shown in FIG. 3A).

The flexible sleeve 300 keeps the rigid insert 302 in contact with the wrist 126 and the elbow 124 of the golfer 102 so as to prevent pivoting of the wrist 126 and pivoting of the elbow 124. The rigid insert 302 may be in contact with the forearm directly or indirectly, depending on various embodiments. The rigid insert 302 may be in contact with the wrist 126 through one or more layers of the flexible sheet 312 so long as the rigidity of the rigid insert 302 affects the pivoting of the respective joints. One or more layers of the flexible sheet 312 may provide comfort to the golfer 102 while retaining the benefits of direct contact.

By holding tightly to the forearm of the golfer 102, the flexible sleeve 300 correspondingly holds the rigid insert 302 tightly to the forearm. This is because the flexible sleeve 300 is secured to the rigid insert 302 through various structures in various embodiments of the invention. In some embodiments, the flexible sleeve 300 includes an insert pocket 322. The elongated rigid insert 302 is disposed at least partially within the insert pocket 322 of the flexible sleeve 300. The insert pocket 322 includes an outer sheet and an inner sheet (as shown and described in FIG. 6 below). The inner sheet is directly in contact with the forearm of the golfer 102 when worn. The outer sheet is away from the forearm. In some embodiments, the outer sheet is the flexible sheet 312 of the flexible sleeve 300. In other embodiments, the inner sheet is the flexible sheet 312 of the flexible sleeve 300. The insert pocket 322 may be formed of one or more layers of the flexible sheet 312, or of another sheet. The insert pocket 322 may be formed separately, with the rigid insert 302 sealed therein, and sewn to the flexible sleeve 300.

In some embodiments, the insert pocket 322 is sealed so as to permanently retain the elongated rigid insert 302 therein. The insert pocket 322 is sealed via sewing or other attaching method. In some embodiments, the insert pocket 322 is selectively sealed, such that the rigid insert 302 may be removed. The rigid insert 302 may be removed for cleaning, or to replace the rigid insert 302 with another insert having a different size and/or shape.

FIG. 4 shows another view of the embodiment of the golf training aid 100 from FIG. 3B. While FIG. 3B shows the fastening straps 310 secured to the flexible sheet 312 of the flexible sleeve 300, FIG. 4 shows the flexible sleeve 300 with the fastening straps 310 extended. The fastening straps 310 extend laterally relative to the flexible sheet 312 of the flexible sleeve 300.

Any of various attachment structure may be utilized by the fastening straps 310. In embodiments, the fastening straps 310 are securable at a customizable length because various golfers will have trailing arms 104 of different sizes. In some embodiments, the fastening straps 310 include a hook-and-loop style fastener (commonly referred to as VELCRO). In some embodiments, as shown in FIG. 4, a loop segment 400 is disposed on a distal end 402 and a hook segment 404 is disposed on a proximal end 406 (for example, on the flexible sleeve 300 itself). In other embodiments, the hook segment 404 is disposed on the distal end 402 and the loop segment 400 is disposed on the proximal end 406. The fastening straps 310 each include the proximal end 406 (proximate to the flexible sheet 312) and the distal end 402 (extended away from the flexible sheet 312). The proximal end 406 may at least partially surround the flexible sheet 312, as shown in FIG. 4B. The fastening straps 310 are secured by rotating the distal end 402 around the flexible sheet 312 (having the forearm of the golfer 102 therein) and securing the distal end 402 to the proximal end 406 or some other structure.

The golfer 102 will loop the fastening straps 310 around their arm and secure them. The hook-and-loop straps keep the rigid insert 302 (discussed more below) firmly in contact (directly or indirectly) with the trailing arm 104 of the golfer 102. It should also be appreciated that other structures may be utilized for securing the flexible sleeve 300 to the trailing arm 104 of the golfer 102. For example, the fastening straps 310 may include any combination of cups, ties, hooks, buttons, zippers, and other mechanical fasteners.

In some embodiments, as shown in FIG. 4, there are two fastening straps 310. The two fastening straps 310 include an elbow fastening strap 408 disposed proximate to the elbow 124 and a wrist fastening strap 410 disposed proximate to the wrist 126. The fastening straps 310 in this orientation provide an inward force to hold the rigid insert 302 against the respective joints to assist in keeping the respective joints from pivoting.

Figure 5A:
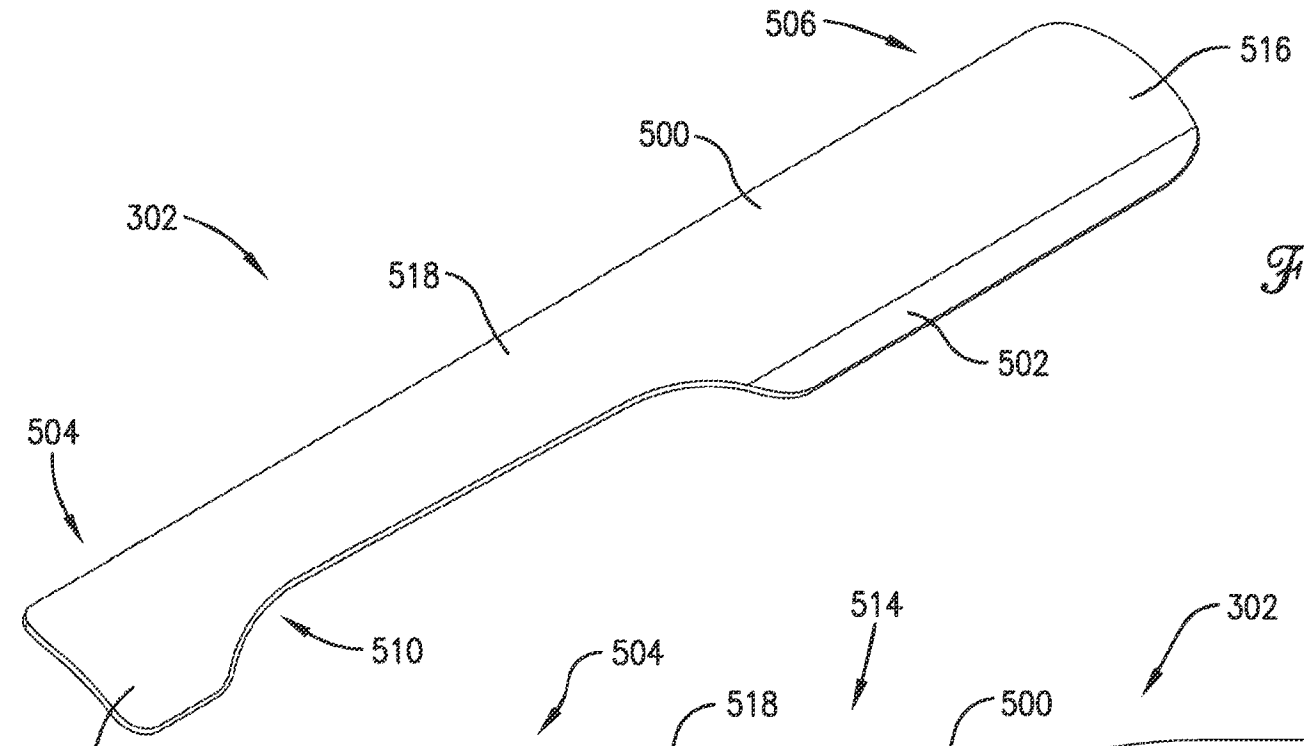
FIG. 5A is a perspective view of the rigid insert.
Figure 5B:
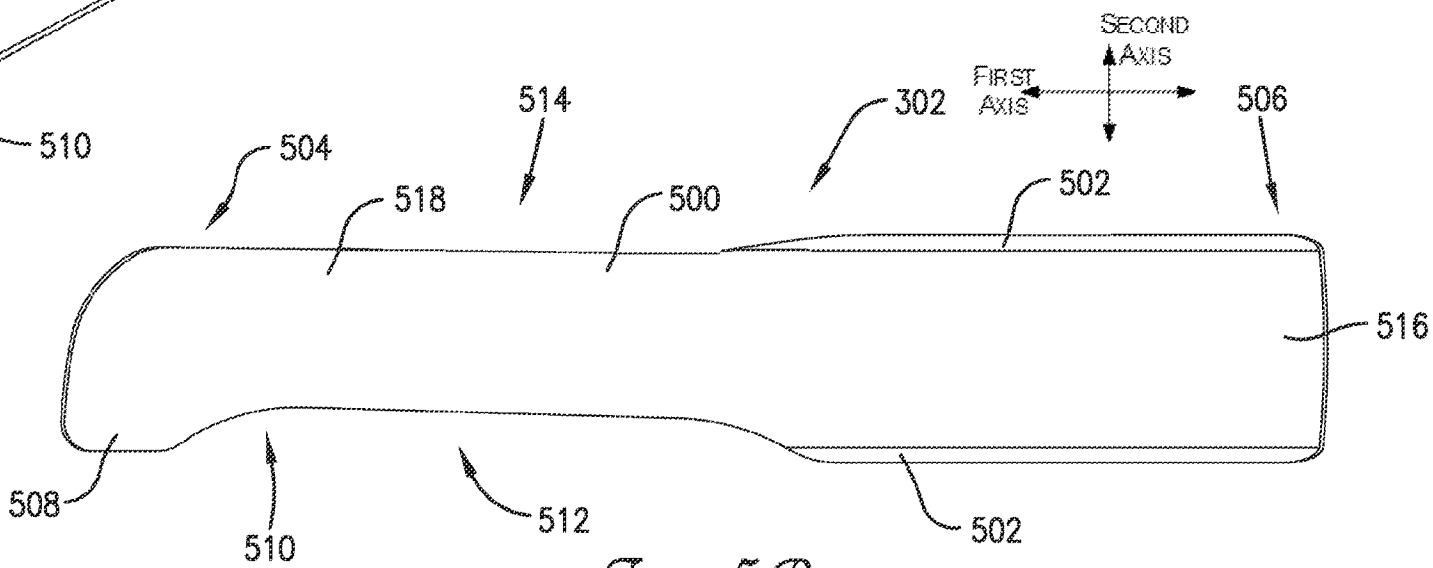
FIG. 5B is a top view of the rigid insert of FIG. 5A.

The rigid insert 302 of embodiments of the invention will now be discussed in more detail. FIG. 5A shows a perspective view of an embodiment of the rigid insert 302. FIGS. 5B-D show alternative views of the rigid insert 302 of FIG. 5A. Specifically, FIG. 5B is a top view of the rigid insert 302, FIG. 5C is a side view of the rigid insert 302, and FIG. 5D is a bottom view of the rigid insert 302. It should be appreciated that the rigid insert 302 of embodiments of the invention may come in other forms, and that the embodiment shown in the figures is only exemplary. For example, the rigid insert 302 shown in the figures is configured to accommodate a left-handed golfer. Other embodiments may be configured for a right-handed golfer or may be ambidextrous.

The rigid insert 302 is generally elongated along a first axis (a left-right axis in FIG. 5B) and generally arcuate along a second axis (an up-down axis in FIG. 5B) perpendicular to the first axis. In embodiments, the rigid insert 302 comprises an elongated arcuate wall 500 and a pair of opposing alignment walls 502 (as best shown in FIGS. 5B and 5G. The arcuate wall 500 extends from a hand end 504 to an elbow end 506, corresponding with respective positions on the trailing arm 104 when worn. The arcuate wall 500 presents a palm segment 508 configured to be disposed on a palm of the golfer 102. A recess 510 allows for the thumb 118 to wrap around the palm segment 508 and grasp the club grip 116. The recess 510 defines an indented side 512 of the rigid insert 302 (as shown in FIGS. 5B and 5D). The indented side 512 is opposite a straight side 514. Both the indented side 512 and the straight side 514 extend between the elbow end 506 and the hand end 504. The palm segment 508 is opposite an arm segment 516 of the arcuate wall 500, with an intermediary segment 518 disposed between the arm segment 516 and the palm segment 508.

Figure 5E:
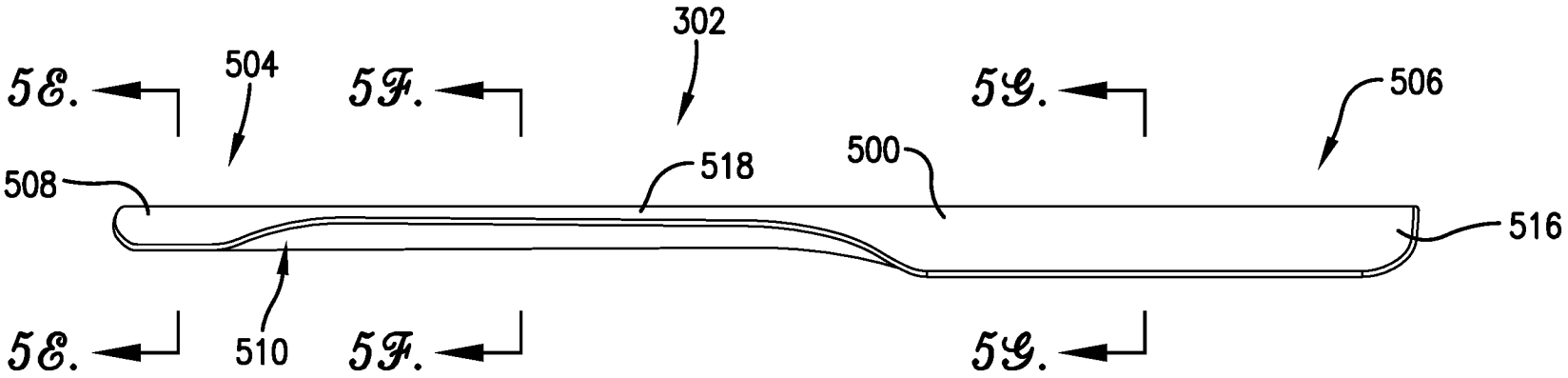
FIG. 5E is a vertical cross-section view of the rigid insert, through the 5E-5E line of FIG. 5C.
Figure 5D:
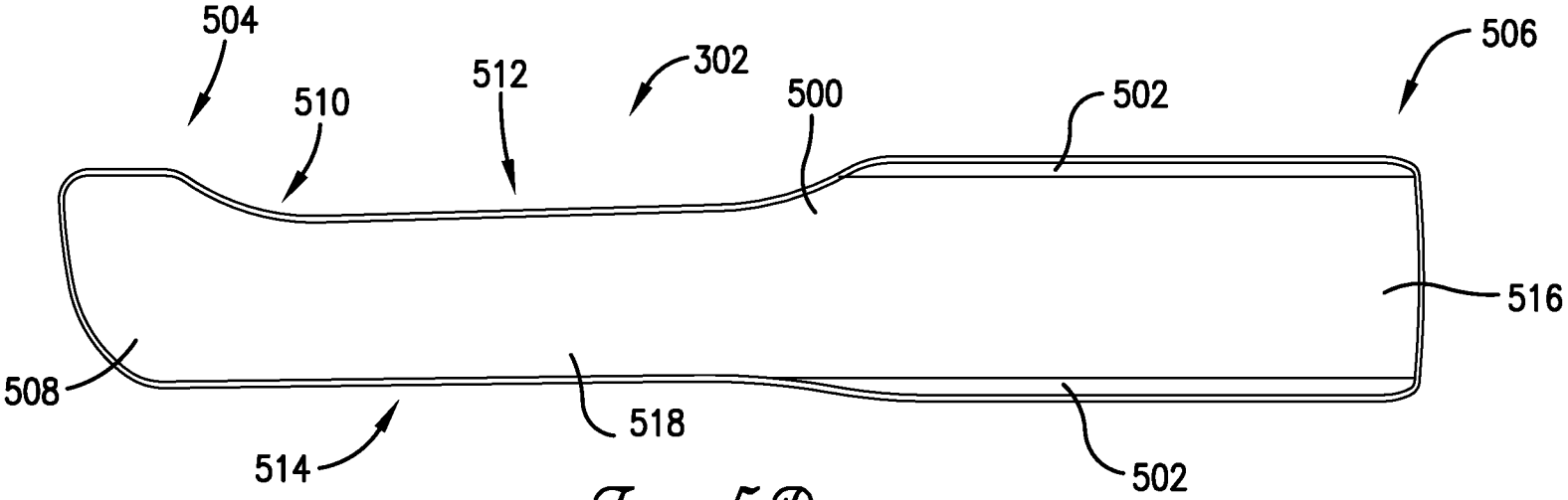
FIG. 5D is a bottom view of the rigid insert of FIG. 5A.
Figure 5F:
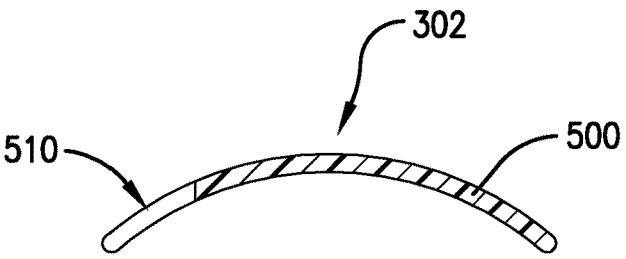
FIG. 5F is a vertical cross-section view of the rigid insert, through the 5F-5F line of FIG. 5C.
Figure 5E:
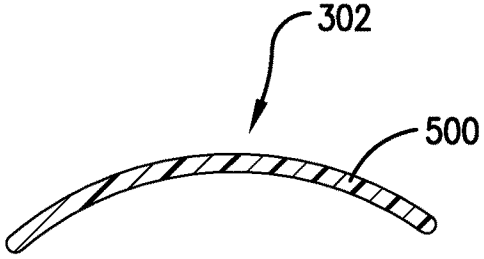
Figure 5G:
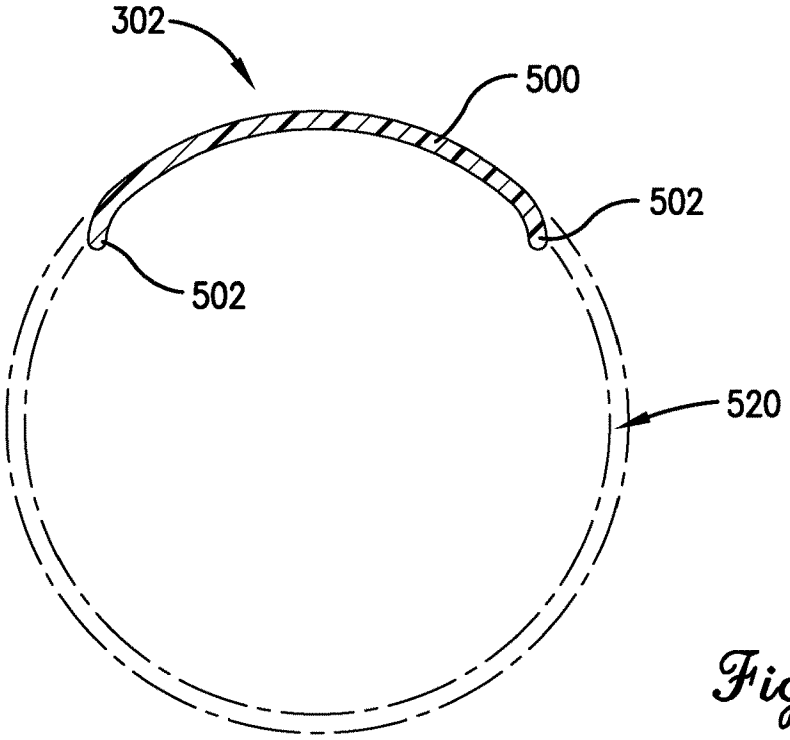
FIG. 5G is a vertical cross-section view of the rigid insert, through the 5G-5G line of FIG. 5C.

FIGS. 5E-G show additional views of the rigid insert 302 from FIG. 5A at a vertical cross-section. As can be seen, the rigid insert 302 is generally arcuate about the cross-sections. FIGS. 5E-F show an arcuate shape of the arcuate wall 500 of the rigid insert 302. FIG. 5E shows the cross-section through the palm segment 508 (the 5E-5E line of FIG. 5C). FIG. 5F shows the cross-section through the intermediary segment 518 (the 5F-5F line of FIG. 5C). The arcuate wall 500 also presents a thickness configured to resist bending (in combination with the arcuate shape) so as to prevent the pivoting of the wrist 126 and elbow 124 as discussed above. FIG. 5G shows the cross-section through the arm segment 516 (the 5G-5G line of FIG. 5C). FIG. 5G shows how the arcuate wall 500 of some embodiments is an arc segment (of the reference circle shown) and that the alignment walls 502 deviate from the arc segment inward toward the forearm of the golfer 102. As can be seen, the arcuate wall 500 may be continuous or monolithic with alignment walls 502.

The arcuate wall 500 that is generally complementary to the forearm of the golfer 102. The arcuate wall 500, as discussed above, is arcuate about a second axis that is perpendicular to a first axis (parallel to the forearm of the golfer 102 while in use). The arcuate wall 500 contours so as to conform with a standard-sized forearm. The rigid insert 302 may, in embodiments, be available in any of numerous sizes (such as adult, child, extra-large, women, men, etc.). The entire golf training aid 100 may also be available in such sizes, or the individual rigid insert 302*s* may be sized.

The arcuate wall 500 of embodiments, as best shown in FIGS. 5E-G, may at least partially be an arc segment of an imaginary circle 520 (or more specifically, an imaginary cylinder). The arc segment shape provides smooth contact with the forearm of the golfer 102. In other embodiments, the arcuate wall 500 is an arc segment of an imaginary cone shape, such that a radial distance to the imaginary center is shorter at the hand end 504 than at the arm end 506 (to more accurately approximate the shape of a human forearm).

In embodiments of the invention, the alignment walls 502 are configured to keep the arcuate wall 500 aligned with the trailing arm 104 of the golfer 102. The alignment walls 502 protrude from the arm segment 516 of the rigid insert 302. As best shown in FIG. 5G, the alignment walls 502 deflect the arcuate wall 500 inward toward the forearm of the golfer 102. The alignment walls 502 prevent lateral displacement of the rigid insert 302, perpendicular to the above-discussed first axis. The alignment walls 502 keep the rigid insert 302 from becoming displaced relative to the elbow 124 of the golfer 102.

The recess 510 is configured to receive a thumb 118 of the golfer 102 therein. The recess 510, which may alternatively be described as a channel, is disposed into the arcuate wall 500, as best shown in FIGS. 5A-D. The recess 510 may be on a single side, the indented side 512 as shown in the figures, or may be disposed on both sides. When on both sides, the rigid insert 302 is ambidextrous and there is no straight side 514. When on a single side, the rigid insert 302 may be left-handed (as shown) or right-handed (if opposing the side shown).

The recess 510 of the rigid insert 302 and the thumb opening 304 of the flexible sleeve 300 (shown in FIGS. 3A and 4) are configured to allow the golfer 102 to grip a golf club 110 while the wrist 126 is stabilized (as shown in FIGS. 1A-C). As shown in FIG. 3A, the recess 510 is disposed adjacent to the thumb opening 304, so that the thumb 118 may pass the recess 510 and out of the thumb opening 304.

The palm segment 508 is presented on the arcuate wall 500 between the recess 510 and the hand end 504. The palm segment 508 is configured to keep the wrist 126 straight, as discussed above. The alignment walls 502 keep the rigid insert 302 aligned with the forearm of the golfer 102. The arcuate wall 500 towards the elbow end 506 is configured to keep the elbow 124 straight, as discussed above. The recess 510 defines a palm segment 508 and the intermediary segment 518 and is configured to stabilize the palm of the golfer 102 while the golfer 102 grips the club grip 116 of the golf club 110.

Exemplary Methods and Materials

While various methods of using the embodiments of the invention have been discussed throughout, a method of golf training utilizing the golf training aid 100 will now be discussed. In some embodiments, the method may be performed by a golf instructor. In other embodiments, the method may be performed by a golf player (e.g., the above-discussed golfer 102 of the golf training aid 100).

A method of golf training broadly includes acquiring the golf training aid 100, donning the golf training aid 100, grasping the golf club 110, and swinging the golf club 110. By doing so, the golfer 102 will have the wrist 126 and elbow 124 of the trailing arm 104 restrained from pivoting during the pitching and/or chipping shot, as described above. Upon repeated use of the golf training aid 100 will, the golfer 102 will become accustom to not pivoting or bending the wrist 126 and elbow 124 (which is an otherwise natural motion during a golf swing). Following the repeated use, the golfer 102 may remove the golf training aid 100 and attempt to keep the wrist 126 and elbow 124 aligned as though the golf training aid 100 were secured to the forearm.

Acquiring a golf training aid 100 may include retrieving, grasping, or otherwise holding the golf training aid 100. The golf training aid 100 may be acquired through a golfing lesson or for individual, independent usage. For example, a golf trainer may provide the golf training aid 100 to a student golfer during a training session, such that the student golfer may practice chipping and pitching swings with the golf training aid 100. Then, subsequent to the lesion, the student golfer will take chipping and pitching swings without the golf training aid 100 but attempting to recreate the motion. As discussed above, the golf training aid 100 includes a flexible sleeve 300 configured to receive the wrist 126 and the elbow 124 of the golfer 102 and an elongated rigid insert 302 secured to the flexible sleeve 300. The flexible sleeve 300 of the golf training aid 100 keeps the rigid insert 302 proximate with the wrist 126 and the elbow 124 of the golfer 102 so as to prevent pivoting of the wrist 126 and pivoting of the elbow 124 during the swing.

Donning the golf training aid 100 includes placing the golf training aid 100 over the trailing arm 104. As discussed above, the trailing arm 104 (as shown in FIGS. 1A-C) is disposed toward the rear during the swinging motion. Donning may include inserting a hand of the trailing arm 104 of the golfer 102 into an elbow end of the flexible sleeve 300. The golfer 102 then extends at least a portion of the hand out of a wrist end of the flexible sleeve 300 such that the rigid insert 302 is aligned with a forearm of the golfer 102. The flexible sheet 312 stretches to allow the forearm to remain tightly against the rigid insert 302.

The step of donning the golf training aid 100 may include a step of securing the golf training aid 100 to a forearm of the golfer 102 by applying an elbow fastening strap and a wrist fastening strap. The fastening straps 310 may be secured via a hook-and-loop fastener, as described above, or other fastening structure. The fastening straps 310 retain the golf training aid 100 relative to the forearm of the golfer 102. More specifically, the elbow fastening strap is disposed at the elbow 124 of the golfer 102 to keep the elbow 124 firmly pressed against the rigid insert 302, and the wrist fastening strap is disposed at the wrist 126 to keep the wrist 126 firmly pressed against the rigid insert 302.

Grasping the golf club 110, as best shown in FIG. 1A, includes gripping the club grip 116 of the golf club 110. Between the palm of the golfer 102 and the club grip 116 is the inner sheet of the insert pocket 322, the rigid insert 302, and the outer sheet of the insert pocket 322. In some embodiments, the inner sheet and the outer sheet of the insert pocket 322 may be distinct from the flexible sheet 312. In these embodiments, the flexible sheet 312 will also be disposed between the palm and the club grip 116.

Swinging the golf club 110 includes the starting position (shown in FIG. 1A), the back stroke (shown in FIG. 1B), striking the ball (shown essentially in FIG. 1A), and the follow-through (shown in FIG. 1C). As can be seen in FIGS. 1A-C, the trailing arm 104 wearing the golf training aid 100 remains substantially straight throughout the swing.

In some embodiments, the method includes removing the flexible sleeve 300 from the wrist 126 and elbow 124 of the golfer 102 following one or more swings while wearing the golf training aid 100. Methods of these embodiments further include swinging the golf club 110 with the golf training aid 100 removed while preventing the pivoting of the wrist 126 and the pivoting of the elbow 124 as when the golf training aid 100 was worn. In this way, the golfer 102 can acquire the skills taught by the golf training aid 100 without having to wear the golf training aid 100 during every swing. This is advantageous because, as discussed above, the golf training aid 100 of embodiments is intended for use only during pitching and chipping shots. Thus, in a standard game, the golfer 102 would need to remove the golf training aid 100 during driving and putting shots. If the golfer 102 can, through practice, acquire the skills to keep the wrist 126 and elbow 124 straight during the pitching and chipping shots, the golfer 102 need not wear the golf training aid 100 during play of the golf game.

Figure 6:
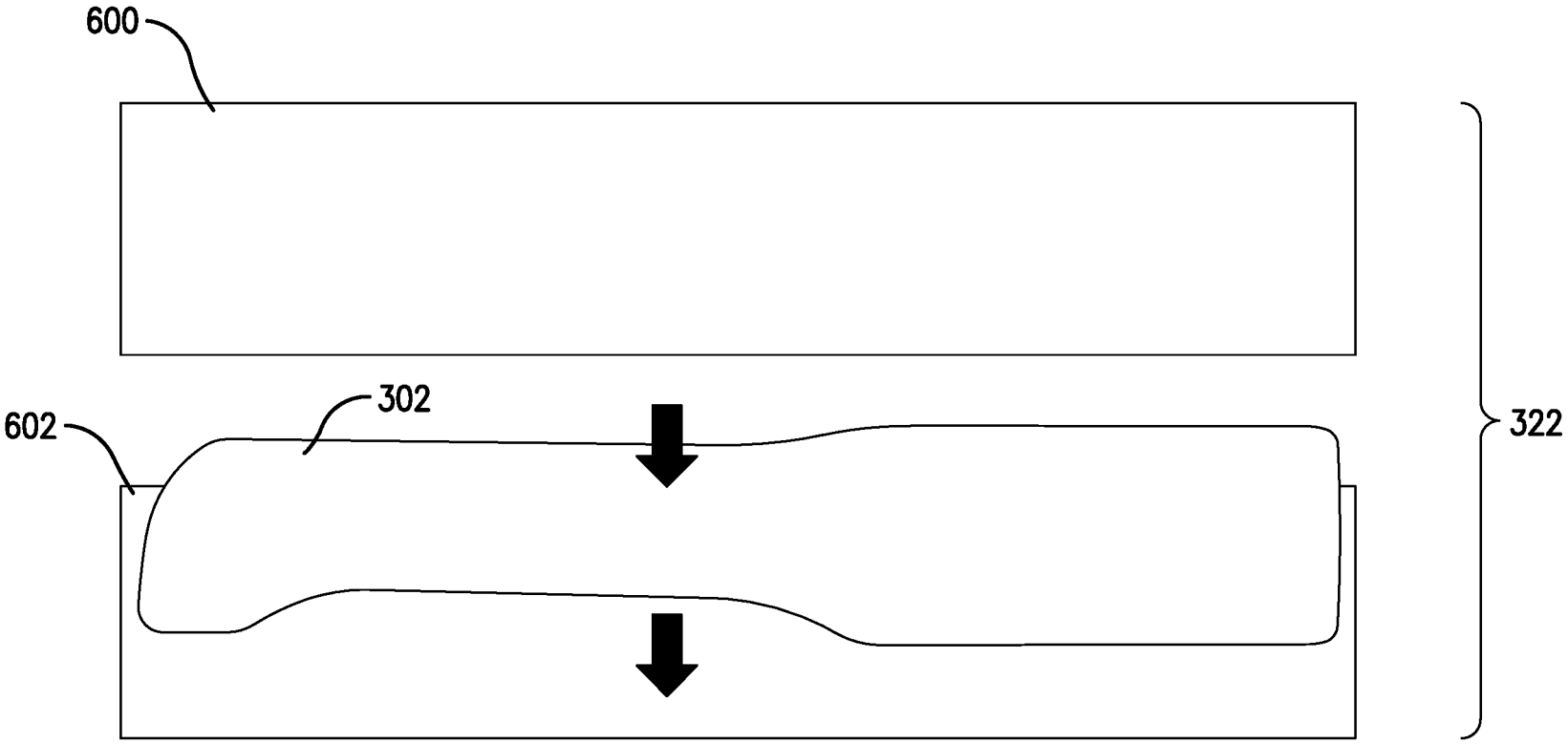
FIG. 6 is a diagram showing assembly of an insert pocket of the golf training aid.

Other embodiments of the invention may be directed to a method of manufacturing the golf training aid 100. FIG. 6 shows how the rigid insert 302 is secured to the flexible sleeve 300 in some embodiments of the invention. As shown, the rigid insert 302 may be sewn between a fabric top 600 and a fabric bottom 602. The fabric top 600 and the fabric bottom 602 are components of the rigid sleeve. In one embodiment, the fabric top 600 is a portion of the flexible sheet 312 of the flexible sleeve 300. In a second embodiment, the fabric bottom 602 is a portion of the flexible sheet 312 of the flexible sleeve 300. In a third embodiment, the fabric bottom 602 and the fabric top 600 are both distinct from the flexible sheet 312 of the fabric sleeve.

In some embodiments of the invention, the rigid insert 302 is formed of a polymer. For example, the rigid insert 302 may be formed of a 3D-printed SLA plastic. As another example, the rigid insert 302 may be cast or extruded. The flexible sleeve 300 may be formed of one or more types of fabric. For example, the central segment may be formed of a blend of 92% polyester and 8% spandex. The insert pocket 322, which contains the rigid insert 302, may be formed of spandex. Trim around the thumb opening 304, the arm opening 308, and the hand opening 306 may be spandex. The straps for securing the golf training aid 100 may be formed of a nylon heavy polypro webbing with VELCRO or other hook-and-loop fastener thereon. These materials are only exemplary. Other embodiments may be formed of other materials.

ADDITIONAL CONSIDERATIONS

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the current technology can include a variety of combinations and/or integrations of the embodiments described herein.

Although the present application sets forth a detailed description of numerous different embodiments, it should be understood that the legal scope of the description is defined by the words of the claim(s) set forth at the end of this patent and equivalents. The detailed description is to be construed as exemplary only and does not describe every possible embodiment since describing every possible embodiment would be impractical. Numerous alternative embodiments may be implemented, using either current technology or technology developed after the filing date of this patent, which would still fall within the scope of the claims.

Throughout this specification, plural instances may implement components, operations, or structures described as a single instance. Although individual operations of one or more methods are illustrated and described as separate operations, one or more of the individual operations may be performed concurrently, and nothing requires that the operations be performed in the order illustrated. Structures and functionality presented as separate components in example configurations may be implemented as a combined structure or component. Similarly, structures and functionality presented as a single component may be implemented as separate components. These and other variations, modifications, additions, and improvements fall within the scope of the subject matter herein. The foregoing statements in the paragraph shall apply unless so stated in this description and/or except as will be readily apparent to those skilled in the art from the description.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus.

Although the invention has been described with reference to the embodiments illustrated in the attached drawing figures, it is noted that equivalents may be employed and substitutions made herein without departing from the scope of the invention.

The invention claimed is:

1. A golf training aid configured to stabilize a wrist and an elbow of a golfer, comprising:

a flexible sleeve having a tubular shape extending from an arm end to a hand end, the flexible sleeve having an arm opening at the arm end, a hand opening at the hand end, and a thumb opening proximate to the hand end, wherein the flexible sleeve is configured to cover both the wrist and the elbow of the golfer when in an as-worn configuration; and an elongated rigid insert permanently sealed in the flexible sleeve, the elongated rigid insert extending from a first end to a second end, the first end being positioned proximate to the hand end of the flexible sleeve, the second end being positioned proximate to the arm end of the flexible sleeve, wherein in the as-worn configuration the flexible sleeve is configured to keep a first segment of the elongated rigid insert proximate with the wrist of the golfer and keep a second segment of the elongated rigid insert proximate with the elbow of the golfer so as to prevent pivoting of the wrist and pivoting of the elbow.

2. The golf training aid of claim 1, wherein the flexible sleeve includes an insert pocket, wherein the elongated rigid insert is disposed within the insert pocket of the flexible sleeve.

3. The golf training aid of claim 2, wherein the elongated rigid insert is sealed within the flexible sleeve via sewing.

4. The golf training aid of claim 1, further comprising: a fastening strap configured to secure the flexible sleeve in place.

5. The golf training aid of claim 4, wherein said fastening strap is an elbow fastening strap disposed proximate to said elbow of said golfer, further comprising:

a wrist fastening strap disposed proximate to said wrist of said golfer.

6. The golf training aid of claim 1, wherein the rigid insert is elongated along a first axis, wherein the first axis aligns with a forearm of the golfer.

7. The golf training aid of claim 6, wherein the rigid insert includes an arcuate wall that is generally complementary to the forearm of the golfer, wherein the arcuate wall is arcuate about a second axis perpendicular to the first axis.

8. The golf training aid of claim 7, wherein the rigid insert further includes an alignment wall extending outwardly from the second segment of the elongated rigid insert and configured to keep the arcuate wall aligned with the forearm of the golfer by contact proximate the elbow of the golfer.

9. The golf training aid of claim 7, wherein the arcuate wall includes a recess between the first segment and the second segment of the elongated rigid insert configured to receive a thumb of the golfer therein, wherein the recess and the thumb opening are configured to allow the golfer to grip a golf club while the wrist is stabilized.

10. The golf training aid of claim 9, wherein the recess defines a palm segment configured to stabilize the palm of the golfer while the golfer grips the golf club.

11. A golf training aid configured to stabilize a wrist and an elbow of a golfer, comprising:

a flexible sleeve having a tubular shape extending from an arm end to a hand end, the flexible sleeve having an arm opening at the arm end, a hand opening at the hand end, and a thumb opening proximate the hand end, wherein the flexible sleeve is configured to cover both the wrist and the elbow of the golfer when in an as-worn configuration; and an elongated rigid insert having a first section, a second section, and a third section all between a first end and a second end, the first section having a first width, the second section having a second width narrower than the first width, and the third section having a third width wider than the second width, the second section being positioned between the first section and the second section, wherein the elongated rigid insert is configured such that the first section is positioned proximate wrist of the golfer and the third section is positioned proximate the elbow of the golfer when the flexible sleeve is in the as-worn configuration, wherein the elongated rigid insert has an arcuate profile along its length.

12. The golf training aid of claim 11, wherein the first end of the elongated rigid insert is configured to be distal to the golfer's wrist when the flexible sleeve is in the as-worn configuration.

13. The golf training aid of claim 11, further comprising:

an elbow fastening strap configured to be disposed proximate to said elbow of said golfer when the flexible sleeve is in the as-worn configuration; and a wrist fastening strap configured to be disposed proximate to said wrist of said golfer when the flexible sleeve is in the as-worn configuration.

14. The golf training aid of claim 11, wherein the elongated rigid insert includes an alignment wall extending outwardly from a side edge of the third section.

15. The golf training aid of claim 11, wherein the second end of the elongated rigid insert is configured to be proximal to the golfer's elbow when the flexible sleeve is in the as-worn configuration.

16. A method of golf training comprising:

acquiring a golf training aid including— a flexible sleeve having a tubular shape extending from an arm end to a hand end, the flexible sleeve having an arm opening at the arm end, a hand opening at the hand end, and a thumb opening proximate to the hand end, wherein the flexible sleeve is configured to cover both the wrist and the elbow of the golfer when in an as-worn configuration, and an elongated rigid insert permanently sealed in the flexible sleeve;

donning the golf training aid;

grasping a golf club; and swinging the golf club, wherein the flexible sleeve of the golf training aid keeps the rigid insert proximate with the wrist and the elbow of the golfer so as to prevent pivoting of the wrist and pivoting of the elbow during the swing.

17. The method of claim 16, further comprising:

removing the flexible sleeve from the wrist and elbow of the golfer;

swinging the golf club with the golf training aid removed while preventing the pivoting of the wrist and the pivoting of the elbow as when the golf training aid was worn.

18. The method of claim 16, wherein the step of donning the golf training aid is performed by:

inserting a hand of the golfer into the arm end of the flexible sleeve; and extending the hand of the golfer out of the hand end of the flexible sleeve such that the rigid insert is aligned with a forearm of the golfer.

19. The method of claim 16, further comprising: securing the golf training aid to a forearm of the golfer by applying an elbow fastening strap and a wrist fastening strap.

* * * * *